US010655288B2

(12) United States Patent
Cornelus et al.

(10) Patent No.: US 10,655,288 B2
(45) Date of Patent: May 19, 2020

(54) ENERGY ABSORPTION ASSEMBLY

(71) Applicant: NV Bekaert SA, Zwevegem (BE)

(72) Inventors: Henk Cornelus, Avelgem (BE); Steven Derycke, Aalter (BE); Christophe Mesplont, Mouvaux (FR); Filip De Coninck, Tremelo (BE); Björn Maiheu, Heestert (BE)

(73) Assignee: NV BEKAERT SA, Zwevegem (BE)

( * ) Notice: Subject to any disclaimer, the term of this patent is extended or adjusted under 35 U.S.C. 154(b) by 28 days.

(21) Appl. No.: 16/068,201

(22) PCT Filed: Feb. 8, 2017

(86) PCT No.: PCT/EP2017/052729
§ 371 (c)(1),
(2) Date: Jul. 5, 2018

(87) PCT Pub. No.: WO2017/144275
PCT Pub. Date: Aug. 31, 2017

(65) Prior Publication Data

US 2019/0017236 A1 Jan. 17, 2019

(30) Foreign Application Priority Data

Feb. 23, 2016 (EP) ..... 16156819

(51) Int. Cl.
*E01F 15/04* (2006.01)
*D07B 1/06* (2006.01)

(52) U.S. Cl.
CPC ..... *E01F 15/0423* (2013.01); *D07B 1/0673* (2013.01); *D07B 2201/1004* (2013.01);
(Continued)

(58) Field of Classification Search
CPC ..... E01F 15/0423; D07B 1/06; D07B 1/0673; D02G 3/28; D02G 3/38
See application file for complete search history.

(56) References Cited

U.S. PATENT DOCUMENTS 3,233,870 A * 2/1966 Gerhardt ..... B29C 70/521 256/13.1
3,327,968 A * 6/1967 Converse ..... B64D 1/22 244/3

(Continued)

FOREIGN PATENT DOCUMENTS

CH 449689 4/1968
CN 201087331 7/2008

(Continued)

OTHER PUBLICATIONS

International Search Report dated May 24, 2017 in International Application No. PCT/EP2017/052729.

(Continued)

*Primary Examiner* — Shaun R Hurley
(74) *Attorney, Agent, or Firm* — Wenderoth, Link & Ponack, L.L.P.

(57) ABSTRACT

Assembly for energy absorption, comprising m number of substantially straight steel wires and n number of curved steel cords, at least one of the m number of substantially straight steel wires having a tensile strength of at least 1000 MPa and an elongation at fracture of at least 5%, at least one of the n number of curved steel cords having a tensile strength of at least 2000 MPa and an elongation at fracture of at least 2%, wherein m and n are integers m>1, n>1, and at least one of the m number of substantially straight steel wires and at least one of the n number of curved steel cords are fixed together along their longitudinal direction, and the elongation at fracture of at least one of the m number of substantially straight steel wires is at least 2% larger than the elongation at fracture of at least one of the n number of curved steel cords such that the elongation curve of the assembly comprises three zones (11, 11', 12, 12', 13, 13'), wherein a first zone (11,11') is characterized by an elastic deformation of the substantially straight steel wires, a sec- (Continued)

ond zone (12,12') is characterized by the plastic deformation of the substantially straight steel wires and a third zone (13,13') is composed of the continued plastic deformation of the substantially straight steel wires and the elastic deformation of the curved steel cords.

17 Claims, 5 Drawing Sheets

(52) U.S. Cl.
CPC ..... *D07B 2201/2059* (2013.01); *D07B 2201/2068* (2013.01); *D07B 2401/2005* (2013.01); *D07B 2401/205* (2013.01)

(56) References Cited

U.S. PATENT DOCUMENTS 3,776,520 A 12/1973 Charles et al.
4,975,543 A * 12/1990 Saunders ..... B64D 3/02 114/253
5,287,691 A * 2/1994 Okamoto ..... D07B 1/0646 152/451
5,319,915 A * 6/1994 Kobayashi ..... B60C 9/0007 57/200
5,661,966 A * 9/1997 Matsumaru ..... B60C 9/0007 57/206
5,843,583 A 12/1998 D'Haene et al.
5,911,675 A * 6/1999 Obana ..... D07B 1/064 152/451
5,956,935 A 9/1999 Katayama et al.
6,089,293 A * 7/2000 Niderost ..... B29D 30/3028 152/527
6,332,310 B1 * 12/2001 Miyazaki ..... B60O 9/0007 57/211
6,843,613 B2 * 1/2005 Gelfand ..... B61L 29/08 244/110 C
7,975,463 B2 * 7/2011 Cristofani ..... D07B 1/0646 57/311
8,387,353 B2 * 3/2013 Mullebrouck ..... D07B 1/0613 57/237
8,429,888 B2 * 4/2013 Del Rio Rodriguez ..... D07B 1/0613 57/237
8,992,116 B2 * 3/2015 Sloan ..... E01F 13/12 256/13.1
2003/0221762 A1 * 12/2003 Miyazaki ..... D07B 1/0646 152/527
2007/0031667 A1 * 2/2007 Hook ..... D02G 3/38 428/373
2009/0226691 A1 * 9/2009 Mankame ..... D07B 1/0673 428/222
2011/0225944 A1 * 9/2011 Mullebrouck ..... D07B 1/0613 57/212
2014/0227546 A1 * 8/2014 Mesplont ..... C21D 8/06 428/544

FOREIGN PATENT DOCUMENTS

EP 1 457 596 9/2004
FR 1306419 9/1962
GB 1 272 588 5/1972
WO 2013/107203 7/2013

OTHER PUBLICATIONS

Written Opinion of the International Searching Authority dated May 24, 2017 in International Application No. PCT/EP2017/052729.

* cited by examiner

ENERGY ABSORPTION ASSEMBLY

TECHNICAL FIELD

The present invention relates to an assembly for energy absorption, to a process for manufacturing such an assembly, and the applications of such an assembly.

BACKGROUND ART

A wide variety of energy absorbing means are available for use in situations where it is desirable to absorb or dissipate the energy of an impact.

For ease of reference only, the present invention will now be described with regard to road applications, where impact of an erratic vehicle particularly at high speeds e.g. on the motor way with a stationary object for example a pole or a guardrail can cause severe injury and/or death to occupants travelling in the vehicle. To reduce the damage to vehicle and occupants during a collision, a number of assemblies have been devised to absorb and/or transfer the energy from the impact. Similarly, vehicles that have been driven off the road should be significantly slowed down or even should be completely stopped by contact with an energy absorbing means, reducing the danger when entering areas of risk.

New constructions or designs of safety barriers have been proposed to improve the capabilities of energy absorption. The safety barriers currently in use are normally made of various materials such as steel and concrete. These materials have disadvantages connected with their cost and their heavy weight. The early publications of steel reinforced thermoplastics (SRTP) can be found in patent applications of FR1306419 and CH449689. A further improved construction is disclosed in U.S. Pat. No. 3,776,520, where a steel rod insert is embedded in thermoplastic resin material and the steel rod has a predetermined geometry to produce a controlled failure pattern when the guardrail is subjected to sufficient impact. Chinese utility model CN201087331 and International patent application W02013107203 respectively disclose a W-shaped or wave-shaped guardrail panel both provided with reinforcing rods. Current road barrier systems are continuously and incrementally improved to increase their performance.

DISCLOSURE OF INVENTION

It is an object of the present invention to provide an assembly having good energy absorption when being subjected to an impact.

It is another object of the present invention to provide a guard rail with better energy absorption than conventional guard rails in prior arts.

According to a first aspect of the present invention, there is provided an assembly for energy absorption, comprising m number of substantially straight steel wires and n number of curved steel cords, at least one of and preferably each of the m number of substantially straight steel wires having a tensile strength of at least 1000 MPa and an elongation at fracture of at least 5%, at least one of and preferably each of the n number of curved steel cords having a tensile strength of at least 2000 MPa and an elongation at fracture of at least 2%, wherein m and n are integers, $m \geq 1$, $n \geq 1$, and at least one of the m number of substantially straight steel wires and at least one of the n number of curved steel cords are fixed together along their longitudinal direction, and the elongation at fracture of at least one of and preferably each of the m number of substantially straight steel wires is at least 2% larger than the elongation at fracture of at least one of and preferably each of the n number of curved steel cords such that the elongation curve of the assembly comprises three zones, wherein a first zone is characterized by an elastic deformation of the substantially straight steel wires, a second zone is characterized by the plastic deformation of the substantially straight steel wires and a third zone is composed of the continued plastic deformation of the substantially straight steel wires and the elastic deformation of the curved steel cords.

As a preferred example, at least one of and preferably each of the m number of substantially straight steel wires have a tensile strength of at least 1000 MPa, preferably at least 1500 MPa, and an elongation at fracture of at least 10%, preferably at least 15%.

Herein, the term "wire" refers to a single filament or single elongated element like rod. In the content of the present invention, 'cords' can also be interpreted as 'strands'. It is typically made up of several single filaments and in particular it refers to a plurality of single filaments twisted together. The filaments are twisted with an intended lay length to form a strand or a cord. The cord according the present invention may have any construction. For instance, the cord is formed by twisting two or three steel filaments. Alternatively cords can be made in layers wherein a layer of filaments is twisted with a layer lay length around a center filament or precursor strand resulting in a layered cord (for example a 3+9+15 cords wherein a core strand of 3 filaments twisted together is surrounded by a layer of 9 filaments and finally with a layer of 15 filaments). The "curved steel cords" in this content means steel cords being in non-straight form and having certain curvature. For example, the curved steel cords are in a spiral shape by wrapping around the substantially straight steel wire. As another example, the curved steel cords have waved shape. As a preferred example, the breaking load of the assembly for energy absorption according to the invention is taken by the substantially straight steel wires in a range from 20 to 70%, and the rest is taken by the curved steel cords. More preferably, the breaking load of assembly is taken by the substantially straight steel wires in a range from 40 to 60%.

According to the invention, at least one of the m number of substantially straight steel wires may be high-carbon steel wire having as steel composition:

- a carbon content ranging from 0.40 weight percent to 0.85 weight percent,
- a silicon content ranging from 1.0 weight percent to 2.0 weight percent,
- a manganese content ranging from 0.40 weight percent to 1.0 weight percent,
- a chromium content ranging from 0.0 weight percent to 1.0 weight percent,
- a sulphur and phosphor content being limited to 0.025 weight percent,
- the remainder being iron, said steel wire having as metallurgical structure:

- a volume percentage of retained austenite ranging from 4 percent to 20 percent, the remainder being tempered primary martensite and untempered secondary martensite.

In the present invention, the at least one of the m number of substantially straight steel wires may have a diameter Dw in the range of 0.5 to 8 mm e.g. in the range of 0.5 to 3 mm, and may have a tensile strength Rm of at least 1500 MPa for wire diameters below 5.0 mm and at least 1600 MPa for wire diameters below 3.0 mm and at least 1700 MPa for wire diameters below 0.50 mm.

According the invention, at least one of the m number of substantially straight steel wires and at least one of the n number of curved steel cords are fixed together at "fixation points" along their longitudinal direction at substantially regular intervals. Herein, "fixed together" means that at these fixation points, the substantially straight steel wires and the curved steel cords cannot move freely relative to each other. This fixation of the substantially straight steel wires and the curved steel cords can have different variants. For instance, the substantially straight steel wires and the curved steel cords can be fixed together by welding, immersed in a polymer matrix or by clamping. As an example, the substantially straight steel wires and the curved steel cords can be fixed together by wrapping the curved steel cords around the substantially straight steel wires. As another example, the substantially straight steel wires and the curved steel cords are fixed together by stitched yarns at a plurality of locations.

As an example, at least one of the m number of substantially straight steel wires is wrapped with at least one of the n number of curved steel cords along their longitudinal direction. In a particular example, one steel wire is wrapped with one curved steel cord taken as one assembly. It is noted that the length of the wrapped curved steel cord is longer that the length of the substantially straight steel wire. For instance, at least one of the m number of substantially straight steel wires has a length of Lw and the at least one of the n number of curved steel cords has a length of Lc, and $1.02*Lw \leq Lc \leq 1.20*$ Lw. In the other word, the surplus length or the over length of the curved steel cord with respect to the substantially straight steel wire is preferably in the range of 2% to 20%. More preferably, $1.07*Lw \leq Lc \leq 1.08*$ Lw. Most preferably, the surplus length is around 7.5%. In addition, such an assembly may be immersed in a polymer matrix selected from polyethylene (PE), polypropylene (PP), polyvinyl chloride (PVC), polyamide (PA), high-density polyethylene (HDPE) or polyethylene terephthalate (PET). The substantially straight steel wires and the curved steel cords are preferably coated with metallic corrosion resistant coating e.g. zinc, zinc aluminium or zinc aluminium magnesium alloy. The metallic corrosion resistant coating may be in a range of 10 to 600 $g/m^2$. By placing the assembly in a polymer matrix, the required metallic coating can be reduced to 20 to 200 $g/m^2$, e.g. 50 $g/m^2$ or 100 $g/m^2$.

As another example, at least one of them number of substantially straight steel wires and at least one of the n number of curved steel cords are fixed together along their longitudinal direction by stitched yarns at a plurality of locations. It is possible to secure one substantially straight steel wire together with one curved steel cord by stitched yarns along their longitudinal direction. It is also possible to secure a plurality of substantially straight steel wire together with a plurality of curved steel cord, wherein one substantially straight steel wire is next to one curved steel cord, and stitched together with the curved steel cord by yarns along their longitudinal direction. The curved steel cords are preferably periodically crimped or in a periodic wave shape. More preferably, the assembly of the fixed substantially straight steel wires and the curved steel cords is carried on a textile carrier. Thus, the assembly is in the form of a reinforced strip or ribbon and easy to handle in application.

According to a preferred example, said at least one of the m number of substantially straight steel wires has a diameter of Dw and said at least one of the n number of curved steel cords has a diameter of Dc, and $0.8*Dw \leq Dc \leq 1.2*Dw$. In the other word, the derivation of the diameter of the substantially straight steel wire from the diameter of the curved steel cord is preferably within 20%. As an example, the two diameters are comparable and the derivation between two diameters is within 5%.

The advantage of the assembly for energy absorption according to the present invention is to utilize two type of energy absorbing elements and the combination of both provide unique and excellent energy absorbing characteristic. The first element, i.e. the substantially straight steel wire has high elongation at fracture and reasonable tensile strength. The second element, i.e. the curved cord, has very high tensile strength and reasonable elongation at fracture. These two elements work together as an assembly can provide both high tensile strength and high elongation at fracture. In other words, the elements within the assembly are interconnected in such a way, to increase the amount of energy that is absorbed and/or transferred to the assembly from an external impact. An engineering stress-strain curve is typically constructed from the load deformation measurements. In the test a specimen is subjected to a continually increasing uniaxial tensile force while simultaneous observations are made of the deformation of the specimen. Deformation or elongation is the change in axial length divided by the original length of the specimen. The relationship of the stress-strain or load-elongation that a particular material displays is known as that particular material's stress-strain or load-elongation curve. A load-elongation curve of a straight steel wire and a straight steel cord is respectively illustrated in FIG. 1 (*a*) and (*b*). The energy absorption (also called energy dissipation) at fracture is the integrated area under the entire load-elongation curve to the fracture point where the test specimen is fractured. The load-elongation curve of the assembly according to the present invention is illustrated in FIG. 1 (*c*) and (*d*). FIG. 1(*c*) is a synthetical curve by adding the load elongation curve of the straight steel cord (FIG. 1(*b*)) to the curve of the straight steel wire (FIG. 1 (*a*)). FIG. 1 (*d*) presents a measured curve of an assembly according to the present invention by a load-elongation test. According to the present invention, the elongation at fracture of the substantially straight steel wires is at least 2% larger than the elongation at fracture of the curved steel cords such that the elongation curve of the assembly comprises three zones as shown in FIG. 1 (*c*) and (*d*), wherein a first zone 11, 11' is characterized by an elastic deformation of the substantially straight steel wires, a second zone 12, 12' is characterized by the plastic deformation of the substantially straight steel wires and a third zone 13, 13' is composed of the continued plastic deformation of the substantially straight steel wires and the elastic deformation of the curved steel cords. It should be noted that in zones 11, 11', 12, 12', the curved steel cords do not significantly contribute to the energy absorption of the assembly, as the curved steel cords are essentially straightening rather than elongating. In addition, the assemblies according to the present invention may also have structural elongation (not shown in FIG. 1 here) that can occur before an elastic deformation of the substantially straight steel wires. With the new structure, the proportion of elastic and plastic behaviour is a property of the structure design, and the elastic plastic zone can optionally be sequenced by a second elastic zone before reaching ultimate tensile strength of the structure. In the present invention, said at least one of the m number of substantially straight steel wires has a tensile strength of TSw, said at least one of the n number of curved steel cords has a tensile strength of TSc. The assembly according to the present invention has a tensile strength of TSa, and wherein $TSa \geq 0.7*(TSw+TSc)$.

More importantly, such an assembly used as guard rail or part of guard rail can be designed to provide additional safety measures together with other elements, e.g. the poles. As shown in FIG. 2, assemblies according to the present invention are used as guard rails 20, 20*a*, 20*b* between two poles P0. The ends of the individual assemblies are secured on the poles. For instance, when the guard rail 20 is subjected to a collision of a high speed vehicle C, the substantially straight steel wire of assembly is designed and constructed to be first elongated and certain amount of impact energy is thus dissipated. The remaining impact would be subsequently taken up by the curved steel cords 22 of the assembly, which would become a curve line as shown in FIG. 2, and the poles P0 connected at the ends of the steel cord 22. The substantially straight steel wire may be, but not necessarily, broken under severe impact. The following parts of guard rails (20*a*, 20*b*. . . ) and poles (P1, P2 . . . ) next to the impact location may also take stepwise part of the impact energy transferred from the impact location. Eventually, the high speed car can be completely redirected but the high tensile steel cord is not broken. The poles may be broken depending on the material of the poles, the impact energy and their design.

Additionally, it would also be an advantage to have an assembly that could be quickly and easily manufactured using readily available materials. It would be a further advantage to have an assembly that could be constructed in a range of shapes, such as square, a line, a strip, to suit a range of applications without being expensive to construct. The assembly for energy absorption according to the invention can be used as guard rails or for reinforcing guard rails, impact beam or a part of the bodywork subject to impact. In particular, a guardrail according to the present invention comprises at least one elongated beam having fixing means for its connection to support means and extending horizontally between the support means, wherein said beam is reinforced with at least one assembly for energy absorption as in the invention.

BRIEF DESCRIPTION OF FIGURES IN THE DRAWINGS

Figure 7:
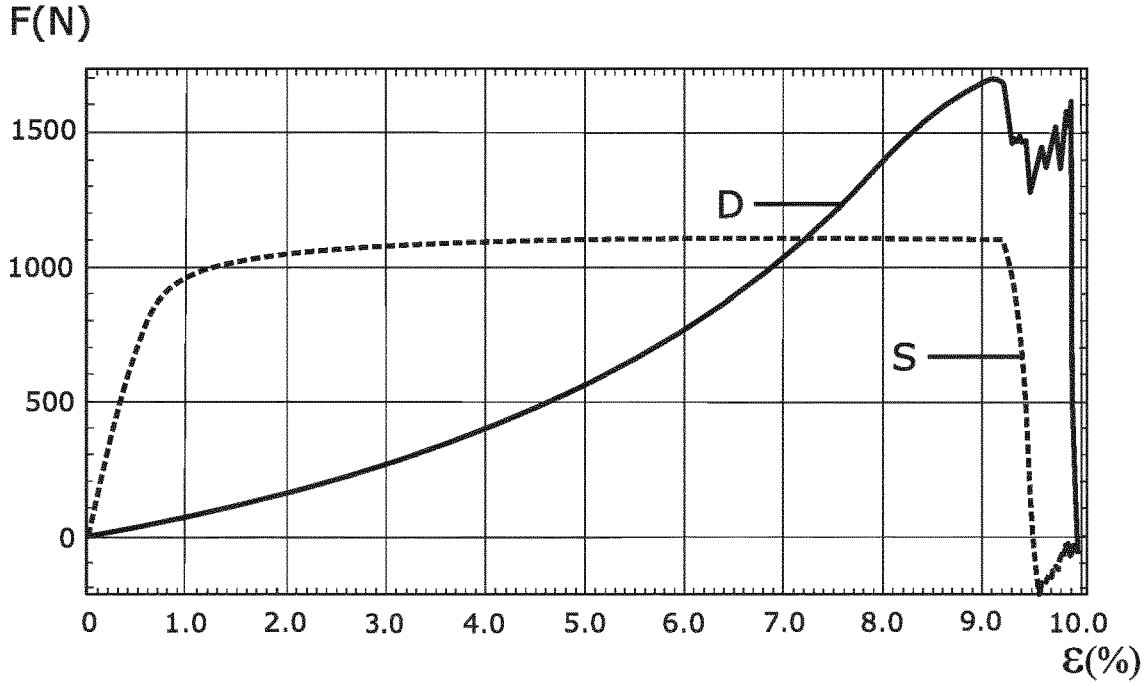

FIG. 7 presents the simulation with respect to the load taken by the curved cord with a 7.0% surplus length and the straight wire as a function of elongation or strain.

Figure 8:
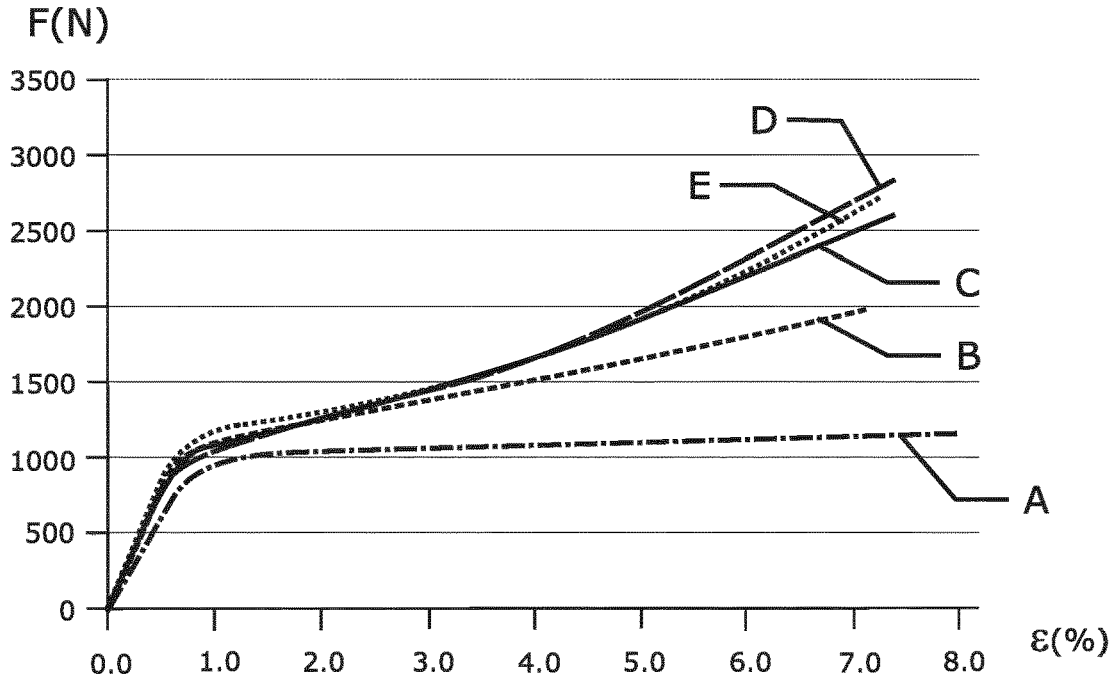

FIG. 8 shows the load-elongation curves of assemblies with different curved cords and similar surplus length.

Figure 9:
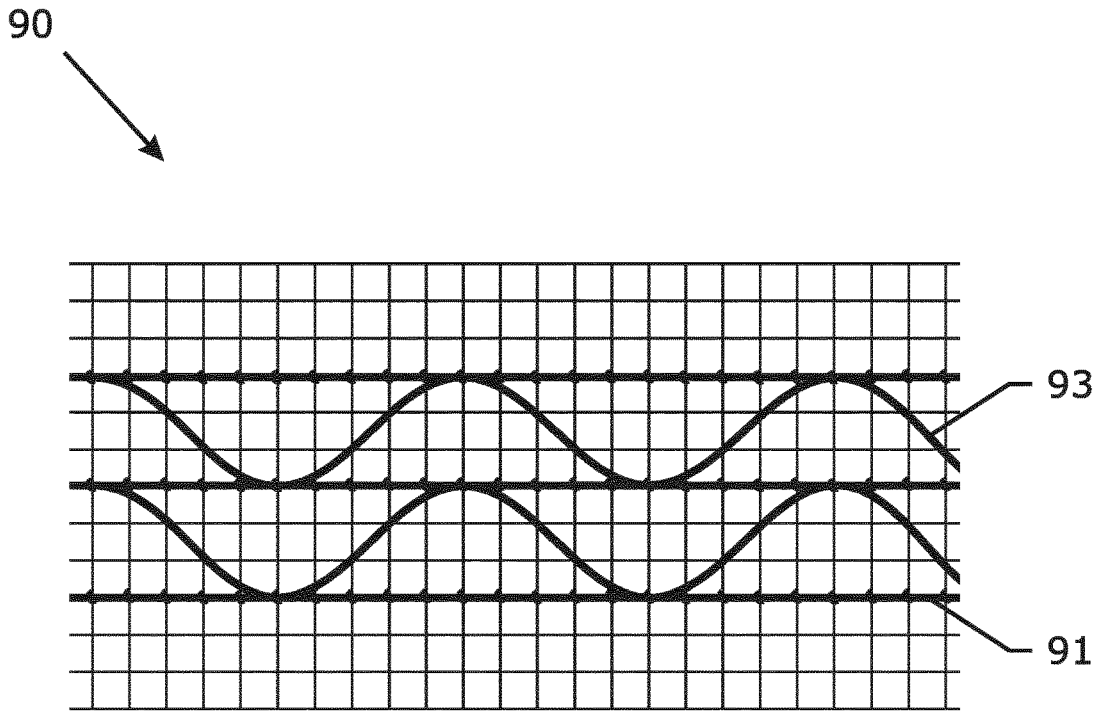

FIG. 9 shows another assembly for energy absorption according to the present invention.

Figure 10:
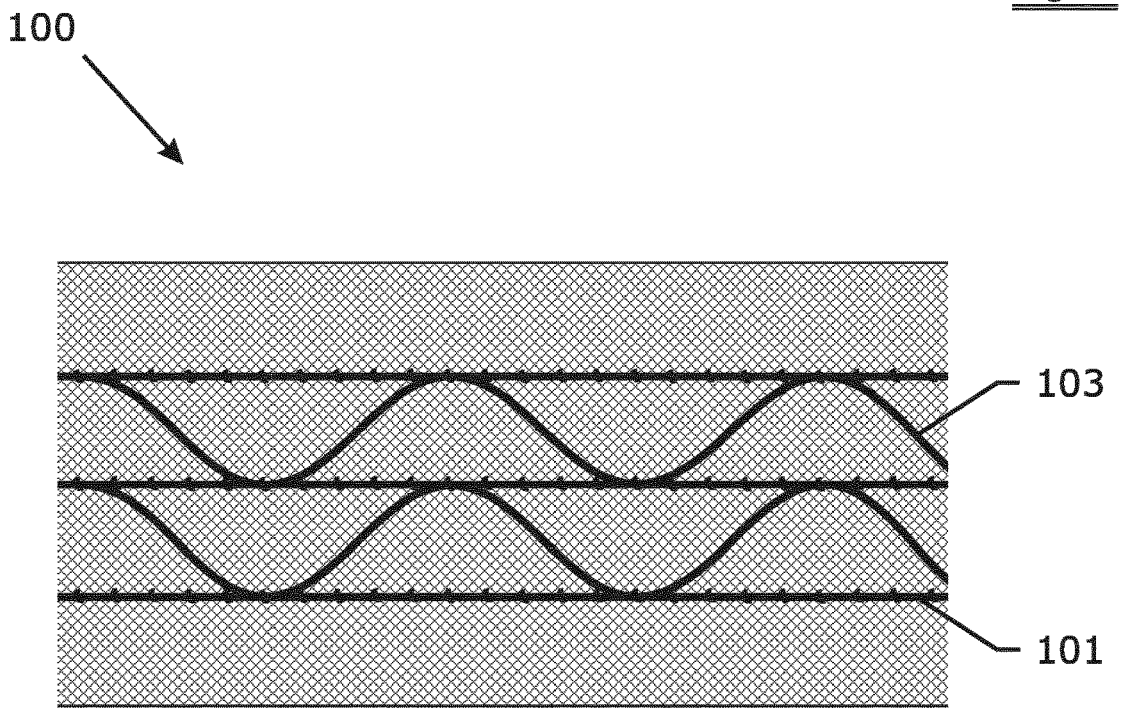

FIG. 10 shows an energy absorption assembly in a textile carrier.

MODE(S) FOR CARRYING OUT THE INVENTION

The present invention describes a steel wire having high strength and very high ductility. This type of steel wire can be produced by a method in a continuous process using an absolutely available chemical composition without expensive micro alloying elements such as Mo, W, V or Nb.

As an example, the substantially straight steel wire according to the present invention can be produced as follows.

The steel wire has following steel composition:

- a carbon content ranging from 0.40 weight percent to 0.85 weight percent, e.g. between 0.45 and 0.80 weight percent, e.g. between 0.50 and 0.65 weight percent;
- a silicon content ranging from 1.0 weight percent to 2.0 weight percent, e.g. between 1.20 and 1.80 weight percent;
- a manganese content ranging from 0.40 weight percent to 1.0 weight percent, e.g. between 0.45 and 0.90 weight percent;
- a chromium content ranging from 0.0 weight percent to 1.0 weight percent, e.g. below 0.2 weight percent or between 0.40 and 0.90 weight percent;
- a sulphur and phosphor content being limited to 0.025 weight percent,
- the remainder being iron and unavoidable impurities. In addition, the steel wire may comprise low amounts of alloying elements, such as nickel, vanadium, aluminium or other micro-alloying elements all being individually limited to 0.2 weight percent.

The process comprises the following steps:

a) austenitizing said steel wire above $Ac_3$ temperature during a period less than 120 seconds; this austenitizing can occur in a suitable furnace or oven, or can be reached by means of induction or a combination of a furnace and induction;

b) quenching said austenitized steel wire between 180° C. and 220° C. during a period less than 60 seconds; quenching can be done in an oil bath, a salt bath or in a polymer bath;

c) partitioning said quenched steel wire between 320° C. and 460° C. during a period ranging from 10 seconds to 600 seconds; partitioning can be done in a salt bath, in a bath of a suitable metal alloy with low melting point, in a suitable furnace or oven, or can be reached by means of induction or a combination of a furnace and induction.

After the quenching step b), which occurs between $M_s$, the temperature at which martensite formation starts and $M_f$, the temperature at which martensite formation is finished, retained austenite and martensite has been formed. During the partitioning step c), carbon diffuses from the martensite phase to the retaining austenite in order to stabilize it more. The result is a carbon-enriched retained austenite and a tempered martensite.

After the partitioning step c), the partitioned steel wire is cooled down to room temperature. The cooling can be done in a water bath. This cooling down causes a secondary untempered martensite, next to the retained austenite and the primary tempered martensite.

Preferably, the austenitizing step a) occurs at temperatures ranging from 920° C. to 980° C., most preferably between 930° C. and 970° C. Preferably, the partitioning step c) occurs at relatively high temperatures ranging from 400° C. to 420° C., more preferably from 420° C. to 460° C. The inventor has experienced that these temperature ranges are favourable for the stability of the retaining austenite in the final high-carbon steel wire.

The produced steel wire for further processing for example has a diameter of 0.92 mm. Several samples are made by wrapping different steel cords respectively around the steel wire. Table 1 shows the weight, load at fracture, tensile strength and elongation at fracture obtained for each individual element.

TABLE 1

Properties of steel wire and cords used in the invention.

| Steel wire | Weight (g/m) 5.22 | Maximum load F (N) 1203 | Tensile strength TS ($N/mm^2$) 1697 | Elongation at fracture At (%) 13.5 |
|---|---|---|---|---|
| 3 × 0.265 + 9 × 0.245 | 4.68 | 1876 | 3151 | 2.45 |
| 2 × 0.54 | 3.59 | 1143 | 2503 | 2.81 |
| 3 × 0.54 | 5.39 | 1762 | 2569 | 2.75 |
| 2 × 0.54 + 2 × 0.54 | 7.25 | 2246 | 2436 | 2.78 |

The cords used with well-defined constructions are shown in Table 1. For example, "3×0.265+9×0.245" indicates three filaments having a diameter of 0.265 mm in the first or inner layer, around by a second or outer layer having 9 filaments each having a diameter of 0.245 mm.

Figure 1:
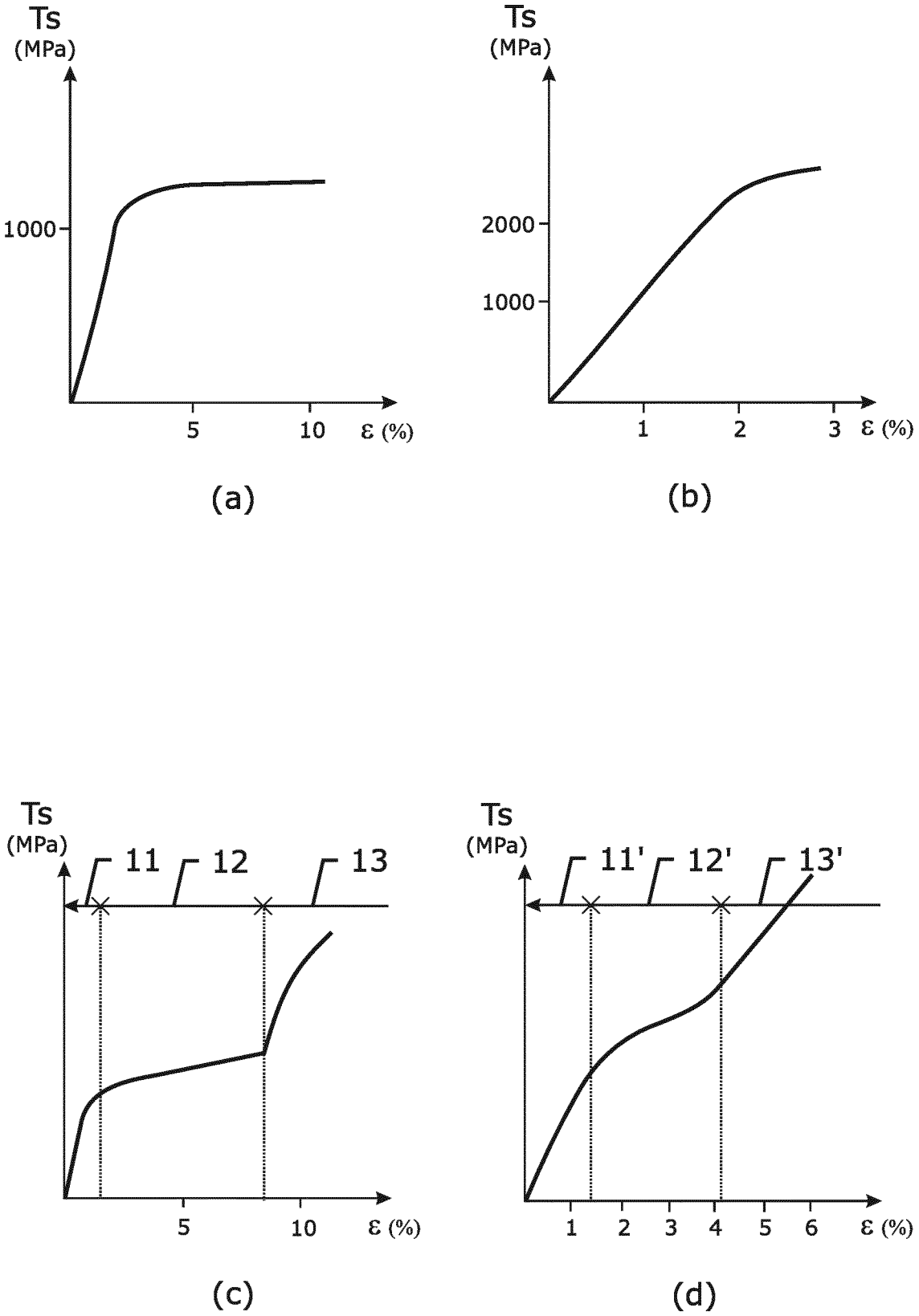
FIG. 1 illustrates load-elongation curves of substantially straight steel wire (a), straight steel cord (b) and assemblies (c) and (d) according to the invention.
Figure 2:
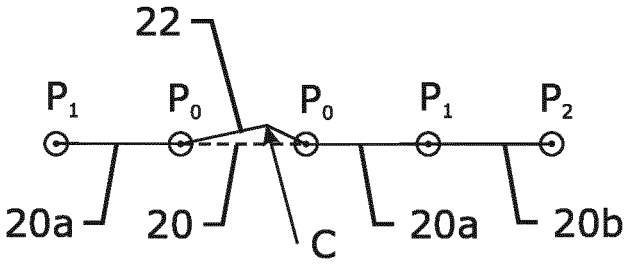
FIG. 2 is a schematic view of a guard rail made by the energy absorption assemblies of the invention subject to a collision of a high speed car.
Figure 3:
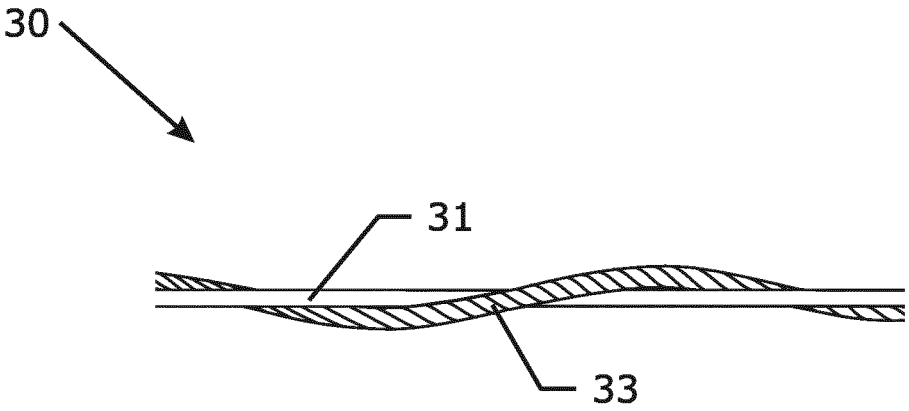
FIG. 3 illustrate an assembly for energy absorption according to the present invention.

In this embodiment, one wire 31 is wrapped with one cord 33 constructing as an assembly 30 as shown in FIG. 3. Table 2 and table 3 are listed the tested samples with individual cord construction, different surplus length, the number (#) of spirals for the wrapping of cords on the wire, the maximum load of the assembly (Fm) and its proportion to the sum of maximum load of the wire and cord (% of Fm sum), the elongation at fracture (At), and observations on which element is broken first when fracture occurs (Fracture first @). The test assemblies in table 2 are made from bright wire, i.e. the wire without coatings. The straight steel wire in the test assemblies in table 3 are over extruded with PE and have a final diameter 1.45 mm. These extruded steel wires have better corrosion protection and allow more surplus length in the steel cord.

Herein the surplus or the over length of steel cod is selected by the following criteria: surplus<At of steel wire−At of steel cord. As shown in table 2 and table 3, the elongation at which ultimate tensile strength of the assembly is reached can be tuned from the elongation value where steel cord fractures (~2%) up to almost the elongation value of the steel wire fractures (13%). The tensile strength of the assemblies reaches at least 70% of the sum of the strength of the individual components.

Figure 4:
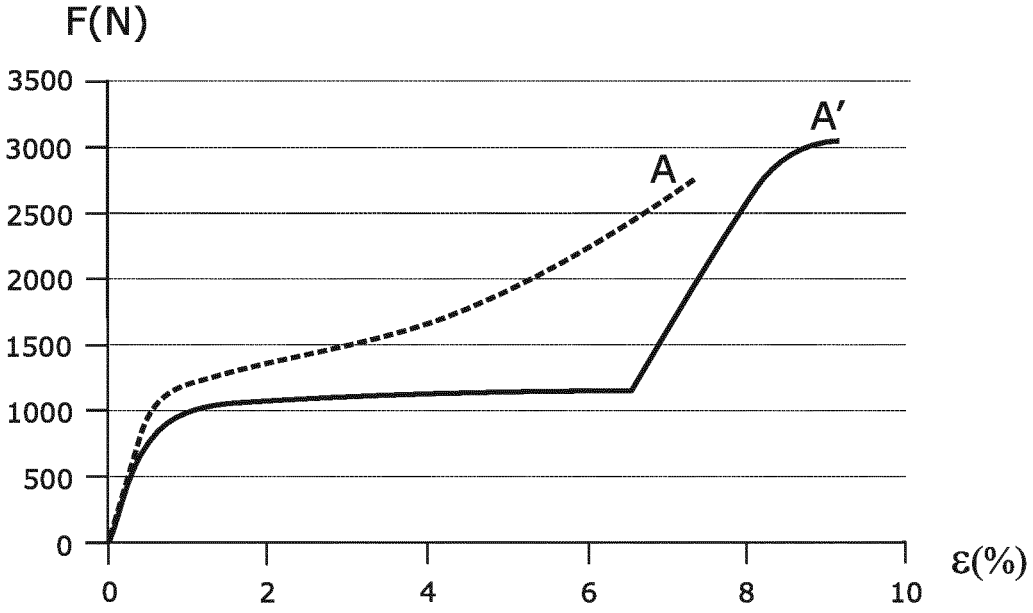
FIG. 4 shows a measured and a synthetical load-elongation curve of an assembly.
Figure 5:
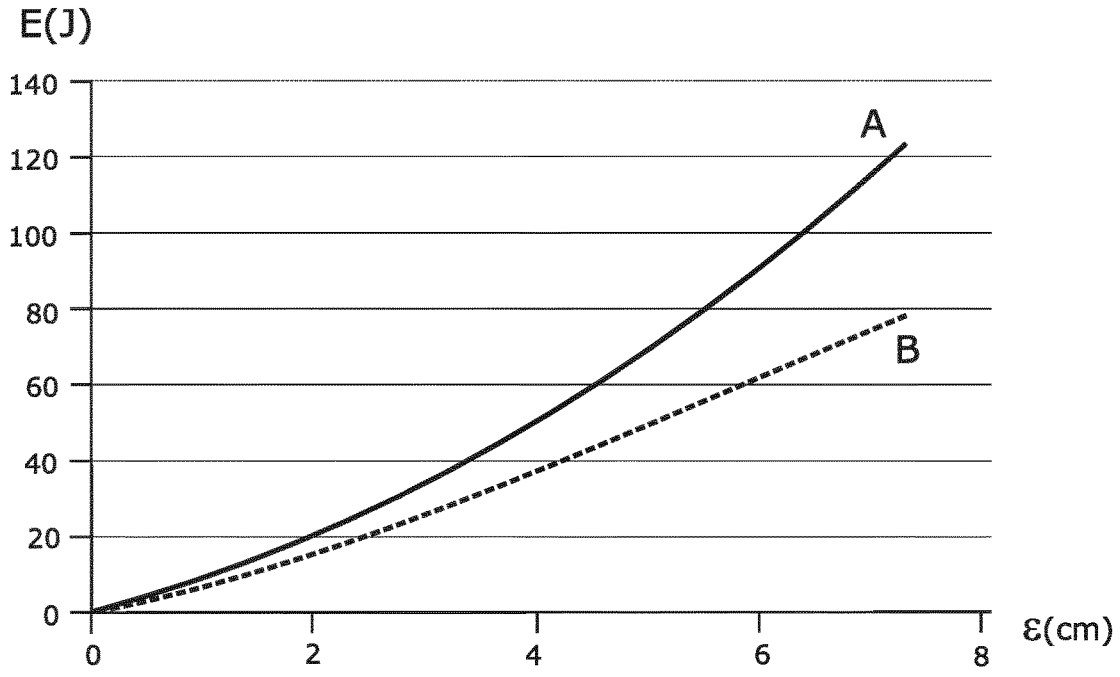
FIG. 5 shows energy absorption as a function of the elongation of the assembly.

FIG. 4 shows the load-elongation curve of an assembly with 3×0.265+9×0.245 cord having a 6.5% surplus length. In FIG. 4, curve A is the measured curve in the test while curve A' is a synthetical curve by adding the load-elongation graph of the steel cord to the graph of steel wire after a certain elongation (6.5% in this case). The energy absorption as a function of elongation of the assembly is shown in FIG. 5. Curve A is the energy absorption as measured while curve B is the energy absorption calculated in line with the curve A' of FIG. 4. The assembly can continuously absorb energy up to 123 Joule on 1 meter with an elongation at about 7.3 cm.

Figure 6:
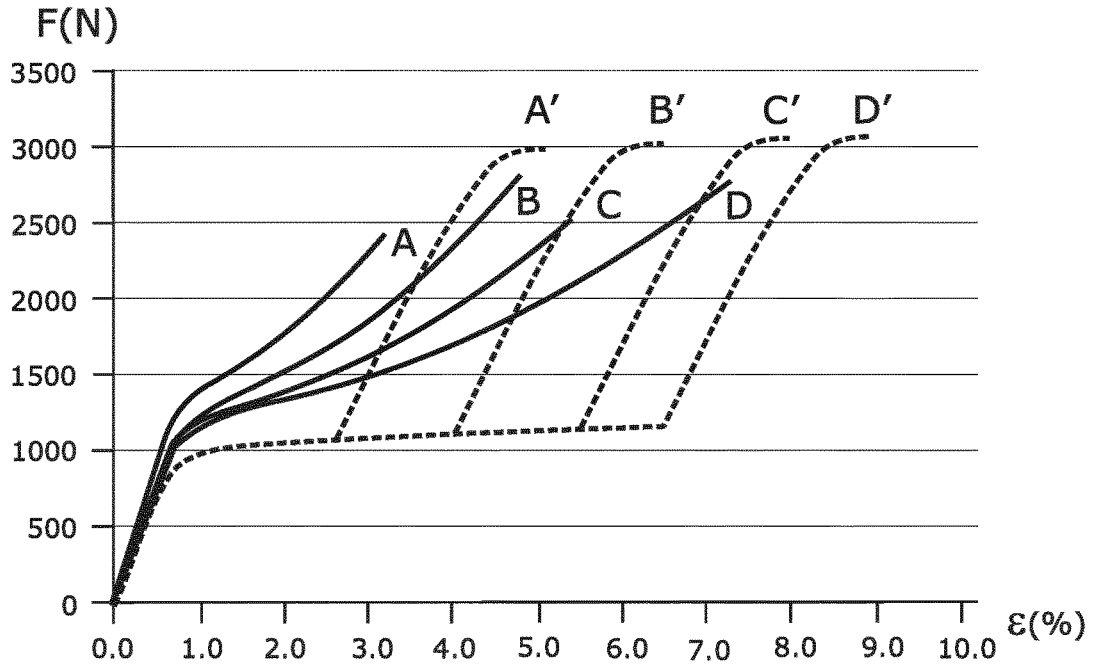
FIG. 6 shows the measured load-elongation curves vs. the synthetical curves of assemblies with different surplus cords.

The measured load-elongation curves vs. the synthetical curves of assemblies with different surplus cords (3×0.265+9×0.245) are compared in FIG. 6. As shown in FIG. 6, curves A, B, C, and D are the measured curve in the test while curves A', B', C' and D' are synthetical curve by adding the load-elongation graph of the steel cord to the graph of steel wire after an elongation of 2.6%, 4%, 5.5% and 6.50% respectively. In the tested range, the assembly with 6.5% surplus cord shows much better elongation and energy absorption capabilities than the others. The inventors further ran a simulation with respect to the load taken by the curved steel cord with a 7.0% surplus and the straight wire as a function of elongation or strain. The result of simulation is illustrated in FIG. 7. Curve D shows the force taken by the curved steel cord while curve S shows the force taken by the straight steel wire. It indicates when the elongation of the assembly below the surplus of the curved steel cord, the steel wire takes more load force than the curved steel wire. Shortly after the elongation of the assembly is bigger than the surplus length of the curved steel cord, the steel cord would take more load force than the straight steel wire.

TABLE 2

Tested samples of a bright steel wire having a diameter of 0.92 mm wrapped with different cords.

| Sample no. | Cord construction | Surplus length % | # spirals/m | Fm | % of Fm sum. | At (%) | Fracture first @ |
|---|---|---|---|---|---|---|---|
| 1 | 3 × 0.265 + 9 × 0.245 | 2.8 | 41 | 2868 | 93 | 4.45 | Cord |
| 2 | 3 × 0.265 + 9 × 0.245 | 4 | 46 | 2841 | 92 | 4.94 | Cord |
| 3 | 3 × 0.265 + 9 × 0.245 | 5.5 | 53 | 2488 | 81 | 5.32 | Cord |
| 4 | 3 × 0.265 + 9 × 0.245 | 6 | 56 | 2813 | 91 | 6.76 | Cord |
| 5 | 3 × 0.265 + 9 × 0.245 | 6.4 | 57 | 2599 | 84 | 6.73 | Cord |
| 6 | 3 × 0.265 + 9 × 0.245 | 6.5 | 58 | 2740 | 89 | 7.25 | Cord |
| 7 | 2 × 0.54 | 7.2 | 64 | 2006 | 89 | 7.22 | Wire |
| 8 | 2 × 0.54 | 12 | 82 | 1482 | 63 | 6.08 | Wire |
| 9 | 3 × 0.54 | 1.7 | 29 | 2771 | 94 | 3.01 | Cord |
| 10 | 3 × 0.54 | 2.7 | 37 | 2815 | 95 | 4.13 | Cord |
| 11 | 3 × 0.54 | 4 | 49 | 2241 | 76 | 4.14 | Cord |
| 12 | 3 × 0.54 | 6.4 | 59 | 2617 | 88 | 7.43 | Cord&Wire |
| 13 | 2 × 0.54 + 2 × 0.54 | 2.9 | 46 | 3262 | 95 | 4.80 | Cord |
| 14 | 2 × 0.54 + 2 × 0.54 | 7.5 | 63 | 2841 | 82 | 7.43 | Cord&Wire |

TABLE 3

Tested samples of a steel wire over extruded with PE and wrapped with different cords.

| Sample no. | Cord construction | Surplus length % | # spirals/m | Fm | % of Fm sum. | At (%) | Fracture first @ |
|---|---|---|---|---|---|---|---|
| 15 | 2 × 0.54 | 12 | 80 | 1613 | 69 | 6.97 | Cord |
| 16 | 3 × 0.54 | 7.7 | 60 | 2393 | 81 | 7.55 | Cord |
| 17 | 3 × 0.54 | 10 | 70 | 2454 | 83 | 8.88 | Wire |
| 18 | 2 × 0.54 + 2 × 0.54 | 6.9 | 57 | 2792 | 81 | 7.23 | Wire |

The load-elongation curves of assemblies with different curved cords and similar surplus length are compared in FIG. 8. As shown in FIG. 8, curves A, B, C, D, E respectively present load-elongation graphs of a bright steel wire having a diameter of 0.92 mm (curve A), and sample no. 7 (curve B), 12 (curve C), 14 (curve D) and 6 (curve E) in table 2. It shows the cord construction together with the surplus length can influence the tensile strength and the energy absorption of the assemblies.

As another embodiment, instead of wrapping one cord on one wire, several cords and several wires are fixed together by stitches. As shown in FIG. 9, an assembly for energy absorption 90 comprises two curved steel cords 93 in a waved shape and three substantially straight steel wires 91 being stitched together by steel filaments or yarns, e.g. nylon, high tensile PET or HDPE. The maximum and minimum of the waved steel cords contacts periodically with the two adjacent straight steel wires along their longitudinal direction and are secured with the steel wire by stitches. The stitches can be applied with a woven net as shown in FIG. 9. The straight steel wires are substantially parallel to each other and the waved steel cords are also preferably parallel to each other. Such assembled cords and wires are in the form of strip or ribbon. In a preferred example, the assembly 100 made from the curved steel cords 103 and substantially straight steel wires 101 is carried by a textile, e.g. via stitching as shown in FIG. 10.

According to the present invention, a guardrail may be made from the energy assembly as described above. Preferably, the assemblies are immersed in a HDPE or PA matrix. Alternatively, such assemblies may be used to repair or reinforce the existing road safety barriers, e.g. the W-shaped or waved shaped beam as mentioned in the background. For instance, a guardrail comprises at least one elongate beam, e.g. made of steel, plastic, HDPE or PA, having fixing means for its connection to support means, e.g. poles, and extending horizontally between the support means, and wherein the beam may be reinforced with at least one assembly for energy absorption as described above.

The invention claimed is:

1. An assembly for energy absorption, comprising m number of substantially straight steel wires and n number of curved steel cords, at least one of the m number of substantially straight steel wires having a tensile strength of at least 1000 MPa and an elongation at fracture of at least 5%, at least one of the n number of curved steel cords having a tensile strength of at least 2000 MPa and an elongation at fracture of at least 2%, wherein m and n are integers, m>1, n>1, and at least one of the m number of substantially straight steel wires and at least one of the n number of curved steel cords are fixed together along their longitudinal direction, and the elongation at fracture of at least one of the m number of substantially straight steel wires is at least 2% larger than the elongation at fracture of at least one of the n number of curved steel cords such that the elongation curve of the assembly comprises three zones, wherein a first zone is characterized by an elastic deformation of the substantially straight steel wires, a second zone is characterized by the plastic deformation of the substantially straight steel wires and a third zone is composed of the continued plastic deformation of the substantially straight steel wires and the elastic deformation of the curved steel cords.

2. The assembly for energy absorption according to claim 1, wherein at least one of the m number of substantially straight steel wires have a tensile strength of at least 1000 MPa and an elongation at fracture of at least 10%.

3. The assembly for energy absorption according to claim 2, wherein at least one of the m number of substantially straight steel wires is high-carbon steel wire having as steel composition:

- a carbon content ranging from 0.40 weight percent to 0.85 weight percent,
- a silicon content ranging from 1.0 weight percent to 2.0 weight percent,
- a manganese content ranging from 0.40 weight percent to 1.0 weight percent,
- a chromium content ranging from 0.0 weight percent to 1.0 weight percent,
- a sulphur and phosphor content being limited to 0.025 weight percent,
- the remainder being iron, said steel wire having as metallurgical structure:

- a volume percentage of retained austenite ranging from 4 percent to 20 percent, the remainder being tempered primary martensite and untempered secondary martensite.

4. The assembly for energy absorption according to claim 1, wherein at least one of the m number of substantially straight steel wires has a diameter $D_w$ in the range of 0.5 to 8 mm.

5. The assembly for energy absorption according to claim 1, wherein said at least one of the m number of substantially straight steel wires have a tensile strength $R_m$ of at least 1500 MPa for wire diameters below 5.0 mm and at least 1600 MPa for wire diameters below 3.0 mm and at least 1700 MPa for wire diameters below 0.50 mm.

6. The assembly for energy absorption according to claim 1, wherein said at least one of the m number of substantially straight steel wires is wrapped with said at least one of the n number of curved steel cords along their longitudinal direction.

7. The assembly for energy absorption according to claim 1, wherein said at least one of the m number of substantially straight steel wires has a length of $L_w$ and said at least one of the n number of curved steel cords has a length of $L_c$, and $1.02*L_w \leq L_c \leq 1.20*L_w$.

8. The assembly for energy absorption according to claim 1, wherein said at least one of the m number of substantially straight steel wires has a diameter of $D_w$ and said at least one of the n number of curved steel cords has a diameter of $D_c$, and $0.8*D_w \leq D_c \leq 1.2*D_w$.

9. The assembly for energy absorption according to claim 1, wherein immersed in a polymer matrix is said at least one of the m number of substantially straight steel wires wrapped with said at least one of the n number of curved steel cords.

10. The assembly for energy absorption according to claim 9, wherein said polymer matrix is made from polyethylene (PE), polypropylene (PP), polyvinyl chloride (PVC), polyamide (PA), high-density polyethylene (HDPE) or polyethylene terephthalate (PET).

11. The assembly for energy absorption according to claim 1, wherein at least one of the m number of substantially straight steel wires and at least one of the n number of curved steel cords are fixed together along their longitudinal direction by stitched yarns at a plurality of locations.

12. The assembly for energy absorption according to claim 11, wherein at least one of the m number of substantially straight steel wires and at least one of the n number of curved steel cords fixed together along their longitudinal direction by stitched yarns is on a textile carrier.

13. The assembly for energy absorption according to claim 1, wherein said at least one of the m number of substantially straight steel wires has a tensile strength of TSw, said at least one of the n number of curved steel cords has a tensile strength of TSc, and said assembly has a tensile strength of TSa, and wherein $TSa \geq 0.7*(TSw+TSc)$.

14. A method of using an assembly for energy absorption according to claim 1 for reinforcing guard rails, impact beam or a part of a bodywork subject to impact.

15. A guardrail, comprising at least one elongate beam having fixing means for its connection to support means and extending horizontally between the support means, said beam being reinforced with at least one assembly for energy absorption as claim 1.

16. The assembly for energy absorption according to claim 1, wherein at least one of the m number of substantially straight steel wires have a tensile strength of at least 1500 MPa, and an elongation at fracture of at least 15%.

17. The assembly for energy absorption according to claim 1, wherein said at least one of the m number of substantially straight steel wires has a length of $L_w$ and said at least one of the n number of curved steel cords has a length of $L_c$, and $1.07*L_w \leq L_c \leq 1.08*L_w$.

* * * * *